United States Patent [19]

Schroder

[11] 4,438,890

[45] Mar. 27, 1984

[54] BOBBIN LOCK

[75] Inventor: William J. Schroder, Spartanburg, S.C.

[73] Assignee: Milliken Research Corporation, Spartanburg, S.C.

[21] Appl. No.: 399,462

[22] Filed: Jul. 19, 1982

[51] Int. Cl.[3] ..... B65H 49/02; D03J 5/08

[52] U.S. Cl. ..... 242/130; 242/55.2

[58] Field of Search ..... 242/55.2, 55.3, 130, 242/131, 129.5, 129.7, 129.71, 129.72; 223/106, 107

[56] References Cited

U.S. PATENT DOCUMENTS

| | | | |
|---|---|---|---|
| 1,498,242 | 6/1924 | Lalonde et al. | 242/55.2 |
| 1,842,718 | 1/1932 | Dunlap | 242/129.7 |
| 2,727,663 | 12/1955 | Gribben | 223/107 |
| 3,430,892 | 3/1969 | Heumann | 242/129.5 |

*Primary Examiner*—Leonard D. Christian

*Attorney, Agent, or Firm*—Earle R. Marden; H. William Petry

[57] ABSTRACT

A yarn package for a creel which employs a creel adaptor to be securely attached in position on the creel. The creel adaptor includes a spring member mounted thereto which engages the end of the yarn package to maintain the yarn package in position on the creel pin of the yarn creel.

3 Claims, 2 Drawing Figures

BOBBIN LOCK

This invention relates to yarn packages for a yarn to be used in forming a fabric or to be further processed. In particular, the invention is directed to apparatus to securely maintain a yarn package on a yarn creel.

It is therefore an object of the invention to provide a yarn package which will securely be held on a yarn creel.

Figure 1:
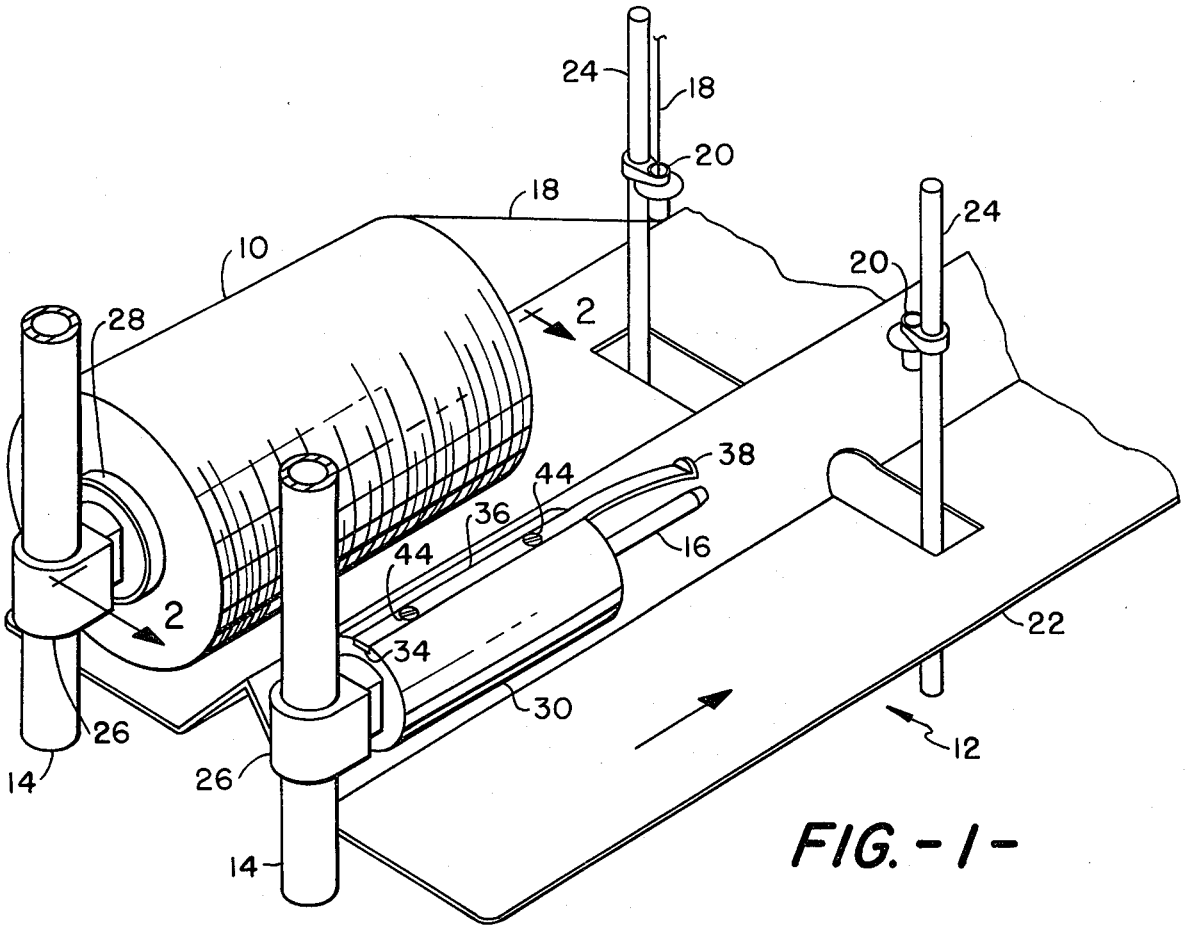
Figure 2:
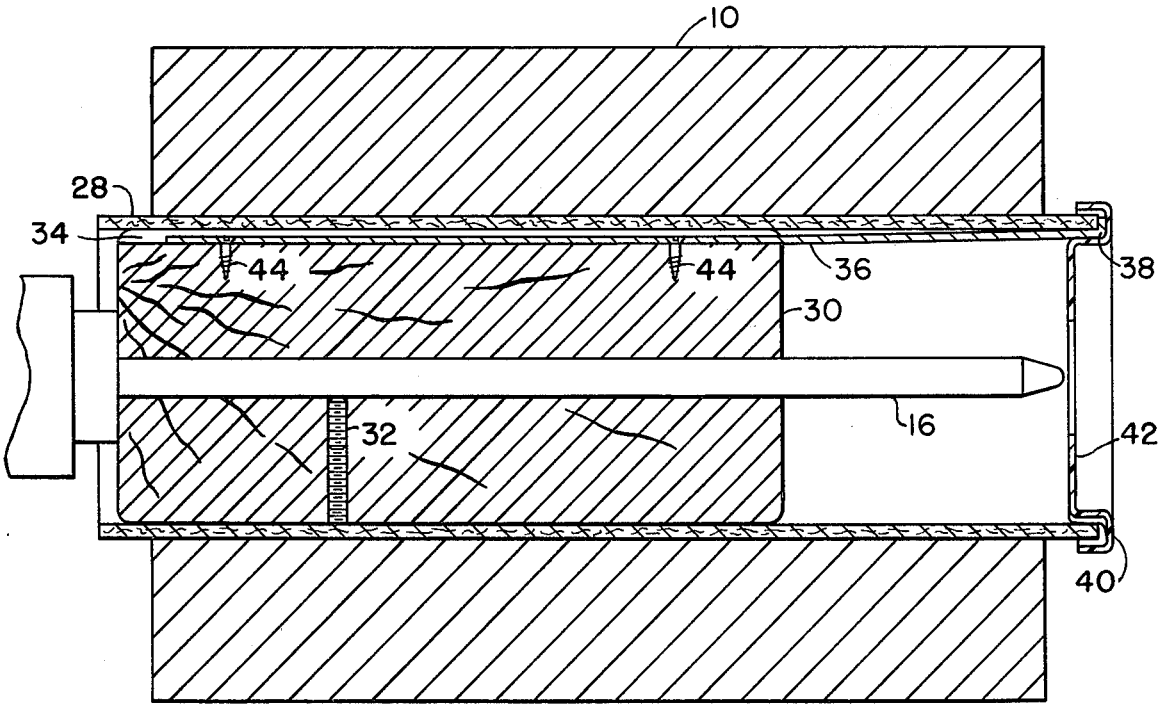

Other objects and advantages of the invention will become readily apparent as the specification proceeds to describe the invention with reference to the accompanying drawings, in which:

FIG. 1 is a partial schematic representation of a creel for a textile processing machine; and FIG. 2 is a cross-section view taken on line 2—2 of FIG. 1 showing the yarn package mounting arrangement.

Looking now to FIG. 1 a creel to mount and supply a plurality of yarn packages 10 for a false twist texturing machine (not shown) is partially shown. The creel, generally designated 12, is not part of the invention and consists of a plurality of upstanding support members 14 mounted on a carriage which is slid into and out of position relative to the texturing machine in order to doff empty yarn packages and don full yarn packages. In recent years the textile industry has been using larger and larger yarn packages to reduce the number of package changes necessary during any particular operating cycle. This has created a problem when using slidable or movable creels which support a multiplicity of yarn packages because the heavy yarn packages 10 tend to slid forward off the creel pin 16 when the creel 12 is slid or moved forward, as indicated by the arrow, to its operative position whereat the creel is stopped and the yarn 18 is delivered through the guide 20 to the texturing machine. When the package 10 slides forward, due to the inertia of the moving creel, the yarn end tends to break, causing a disruption of the yarn processing at the particular spindle.

In FIG. 1 only a partial creel 12 is shown illustrating a full yarn package 10 in position and an empty creel in position on a horizontal support plate 22 and a plurality of yarn guide supports 24 with guide members 20 mounted thereon to guide yarn 18 from the package 10 to the texturing machine (not shown).

In normal operation the support members 14 have creel pin attachment journals 26 telescoped thereover to support the creel pin 16 in the desired direction to support the yarn package 10. Since the yarn tubes 28 for various yarn packages differ in internal diameter it is usually necessary to secure a yarn adaptor 30 of wood, plastic or other suitable material to the creel pin 16 by any suitable means such as a set screw 32. The external diameter of the adaptor 30 conforms to the internal diameter of the yarn tube 28. As discussed above the yarn package 10 has a tendency to slide forward on the adaptor when the creel 12 is slid into operating position.

To prevent the above action, a groove 34 is cut in the outer surface of the adaptor 30 of a depth and width to accommodate the lock spring 36 of suitable material, such as spring steel. The lock spring 36 is of a length to match the length of the yarn tube 28 so that the flange portion 38 of the spring 36 will engage the outer end of the tube 28 when bent upward from its downward sloping position. To insure that the flange portion 38 of the lock spring 36 stays engaged with the yarn tube end, a suitable end cap 40 is mounted in the end of the yarn tube 28 and has an indented circular portion 42 to engage the end of the lock spring 36.

It can now be seen, since the lock spring 36 is securely mounted on the adaptor 30 by suitable means such as screws 44, that the yarn package 10 cannot move relative to the adaptor 30 because the flange portion 38 of the lock spring 36 holds the yarn tube 28 in a fixed position.

Although the preferred embodiment of the invention has been described, it is comtemplated that changes may be made without departing from the scope or spirit of the invention and it is desired that the invention be limited only by the claims.

I claim:

1. An adaptor for a yarn creel comprising: an elongated substantially rigid body member, an elongated axial hole in said body member, a groove formed in the outer surface of and extending substantially the full length of said body member and a spring steel member mounted in and substantially filling said groove and extending outwardly from at least one end of said body member, said spring steel member having the outer extremity bent substantially perpendicular to the plane of the body of the steel member, said spring steel member extending beyond the end of said body member is bent slightly downwards toward the centerline of said body member.

2. A creel yarn package comprising: an elongated, substantially rigid body member adapted to be fixed to a creel pin, a yarn package having a core telescoped over and having one end extending beyond at least one end of said body member, a groove in the outer surface of said body member, an elongated spring steel member mounted in said groove between said body and said core, said spring steel member extending outwardly towards said one end of said core and having a flange portion engaging the end of said core to maintain said core on said body member and a cap member connected onto the end of said core with a portion thereof engaging and maintaining said flange portion into engagement with said core.

3. A creel for a yarn consuming machine comprising a plurality of yarn package support members, each yarn support member having a creel pin projecting outwardly therefrom, an elongated, substantially rigid adaptor member mounted on each of said creel pins, means to secure said adaptor members to said creel pins, a yarn package telescoped over said adaptors having a core extending therebeyond, a groove in the outer surface of each of said adaptors, a second means mounted in each of said grooves between said core and said adaptor member engaging the end of said core to prevent said core from sliding off said adaptor, said second means including an elongated spring steel member mounted to the adaptor member, said spring steel member having an upstanding flange on one end engaging the end of said core and a cap member connected onto the end of said core with a portion thereof engaging and maintaining said upstanding flange into engagement with said core.

* * * * *